US008752954B2

(12) United States Patent
Sato et al.

(10) Patent No.: US 8,752,954 B2
(45) Date of Patent: Jun. 17, 2014

(54) SHEET CONVEYANCE APPARATUS AND PRINTING APPARATUS

(71) Applicant: Canon Kabushiki Kaisha, Tokyo (JP)

(72) Inventors: Ryosuke Sato, Kawasaki (JP); Kenji Shigeno, Yokohama (JP); Masato Izumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/645,923

(22) Filed: Oct. 5, 2012

(65) Prior Publication Data

US 2013/0100223 A1 Apr. 25, 2013

(30) Foreign Application Priority Data

Oct. 21, 2011 (JP) ..... 2011-231284

(51) Int. Cl.
*B41J 2/01* (2006.01)
*B65H 5/08* (2006.01)

(52) U.S. Cl.
USPC ..... 347/104; 271/10.12

(58) Field of Classification Search
USPC ..... 347/104, 106; 226/188; 271/3.12, 9.1, 271/10.12, 242, 272, 274; 400/624, 630, 400/636
See application file for complete search history.

(56) References Cited

U.S. PATENT DOCUMENTS

| | | | | |
|---|---|---|---|---|
| 5,700,006 | A | 12/1997 | Sekiya et al. | |
| 5,765,826 | A | 6/1998 | Isoda et al. | |
| 5,933,697 | A * | 8/1999 | Onodera et al. | 399/406 |
| 5,975,516 | A * | 11/1999 | Maruchi et al. | 271/10.12 |
| 6,527,267 | B1 | 3/2003 | Kuwata et al. | |
| 6,643,480 | B2 | 11/2003 | Kuwata et al. | |
| 7,029,006 | B2 | 4/2006 | Izumi et al. | |
| 7,032,900 | B2 | 4/2006 | Nishikata et al. | |
| 7,694,962 | B2 * | 4/2010 | Morya et al. | 271/228 |
| 7,708,267 | B2 | 5/2010 | Shigeno | |
| 8,011,656 | B2 * | 9/2011 | Morita | 271/264 |
| 8,079,589 | B2 | 12/2011 | Kinoshita et al. | |

FOREIGN PATENT DOCUMENTS

JP 2009-073614 4/2009

* cited by examiner

*Primary Examiner* — Anh T. N. Vo
(74) *Attorney, Agent, or Firm* — Fitzpatrick, Cella, Harper & Scinto

(57) ABSTRACT

A sheet conveyance apparatus comprising: a sheet conveyance path; a loop forming unit that is disposed on the sheet conveyance path and bends, in a loop, the sheet to be conveyed; and a guide unit that is stepwise high at both sides whereas low at the center, as viewed in a sheet conveyance direction, and extends in the sheet conveyance direction, wherein the sheet sagging in the loop by the loop forming unit enters a guide region being defined between opposite guide faces of paired steps in the stepwise guide unit and having a width according to the width of the sheet, so that the side edges of the sheet abut against the guide faces, thus correcting the skewing of the sheet in the sheet conveyance direction.

21 Claims, 12 Drawing Sheets

SHEET CONVEYANCE APPARATUS AND PRINTING APPARATUS

BACKGROUND OF THE INVENTION

1. Field of the Invention

The present invention relates to a sheet conveyance apparatus and a printing apparatus that prints an image on a sheet.

2. Description of the Related Art

There have been conventionally known a sheet conveyance apparatus provided with a fixed flat guide plate capable of changing the width of a conveyance path to correct a meander occurring during conveyance of an elongated sheet, and a printing apparatus, as disclosed in, for example, Japanese Patent Application Laid-open No. 2009-73614. The guide plate extends in the conveyance direction of an elongated sheet, and functions as a width guide for the elongated sheet, thus correcting a meander.

However, with the configuration in which the fixed guide plate corrects the meander of an elongated sheet, as disclosed in Japanese Patent Application Laid-open No. 2009-73614, the fixed guide plate need be detached and attached (i.e., moved) every time a sheet to be conveyed is changed to another one having a different width. Therefore, when various sheets having different widths are conveyed in a short cycle, the guide plate need be detached and attached (i.e., a moving operation is required) accordingly, thereby raising the problem of poor workability, and further, the problem of erroneous attachment of the guide plate at another width position after the guide plate is detached. Moreover, the addition of an electric mechanism for automatically actuating the guide plate raises the problem of an increase in cost

SUMMARY OF THE INVENTION

The present invention has been accomplished in view of the above-described circumstances. Therefore, an object of the present invention is to provide a sheet conveyance apparatus in which the meander of sheets having different widths can be corrected without detaching and attaching (i.e., a moving operation of) a guide plate, and a printing apparatus.

In order to achieve the object, a sheet conveyance apparatus according to the present invention includes: a sheet conveyance path; a loop forming device that is disposed on the sheet conveyance path and bends, in a loop, the sheet to be conveyed; and a guide device that is stepwise high at both sides whereas low at the center, as viewed in a sheet conveyance direction, and extends in the sheet conveyance direction, wherein the sheet sagging in the loop by the loop forming device enters a guide region being defined between opposite guide faces of paired steps in the stepwise guide device and having a width according to the width of the sheet, so that the side edges of the sheet abut against the guide faces, thus correcting the skewing of the sheet in the sheet conveyance direction.

The present invention can provide the sheet conveyance apparatus and a printing apparatus, in which a guide block according to the width of each of the elongated sheets in the stepwise guide device that is set according to the width of each of the sheets can restrict a widthwise motion of the sheet, thereby correcting the meander of each of the elongated sheets having different widths. That is to say, even if the sheet width is varied, a guide plate need not be detached and attached (a moving operation is not required), and further, an assembling error such as an erroneous attachment of a guide plate does not occur. Moreover, the present invention can provide an inexpensive sheet conveyance device and a printing apparatus, in which it is unnecessary to provide a mechanism for electrically moving a guide plate so as to be automatically adapted for each of the sheet widths.

Further features of the present invention will become apparent from the following description of exemplary embodiments (with reference to the attached drawings).

DESCRIPTION OF THE EMBODIMENT

First Preferred Embodiment

Figure 1:
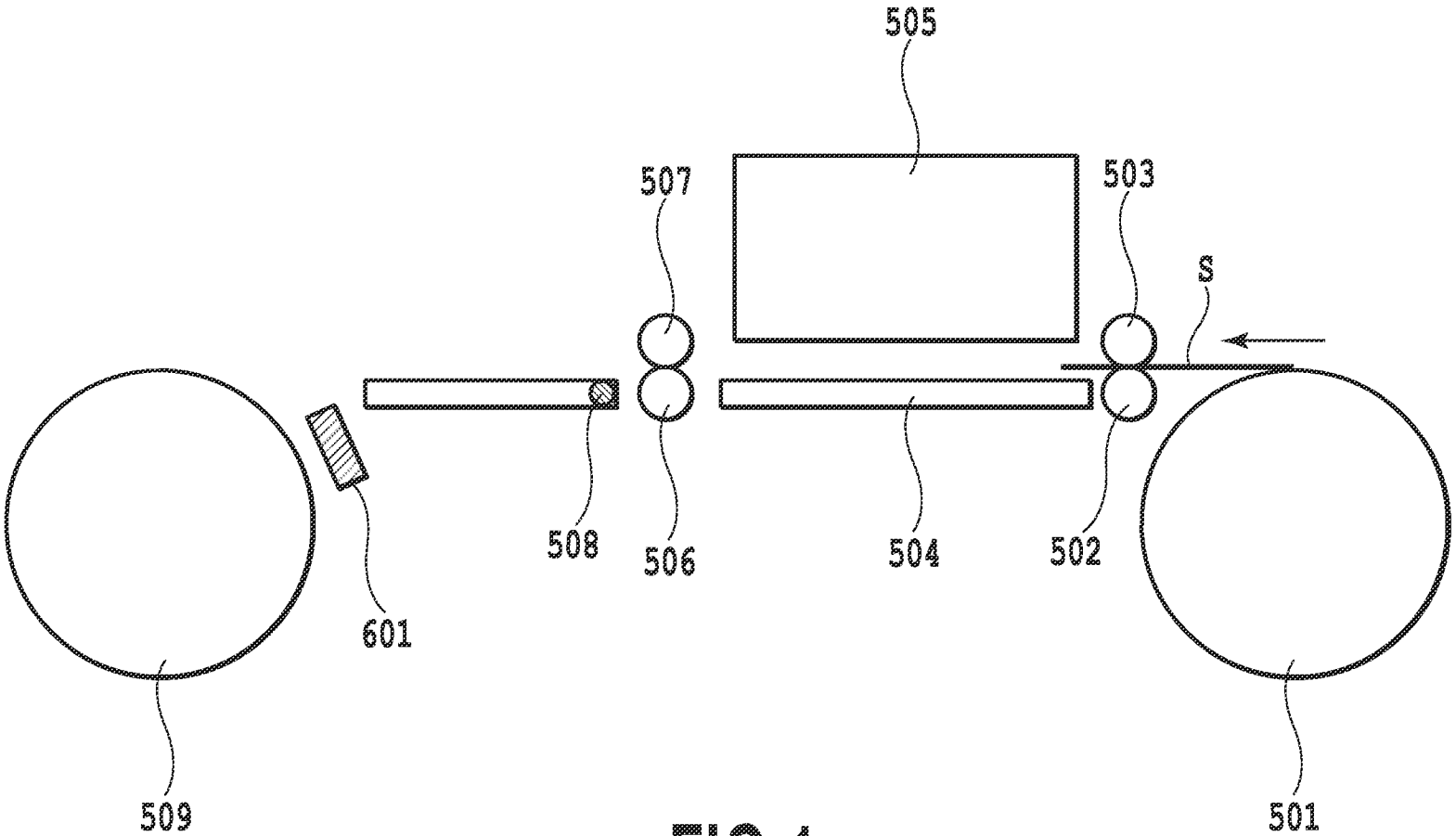
FIG. 1 is a schematic view showing the inside configuration of a printing apparatus according to a first preferred embodiment.

A description will be given below of a printing apparatus in a first preferred embodiment according to the present invention. The printing apparatus in the present preferred embodiment adopts an ink jet system in which a print is made on either side of a continuous sheet wound in a roll in a simplex print mode. As shown in FIG. 1, the printing apparatus includes a sheet feeding flange 501 for unrolling a continuous sheet S; a printing head 505 for printing on the continuous sheet S; and a winding flange 509 for winding the continuous sheet S (i.e., a second conveying device). At any positions on a sheet conveyance path in the present preferred embodiment, a side near the sheet feeding flange 501 is referred to as "upstream" whereas an opposite side apart from the sheet feeding flange 501 is referred to as "downstream." A sheet feeding roller 502 and a sheet feeding pinch roller 503 are disposed downstream of the sheet feeding flange 501 and upstream of the printing head 505. A lower surface pass guide 504 is disposed under the printing head 505. There are provided a loop roller 506 (i.e., a first conveying device) and a loop pinch roller 507, a loop lower surface pass guide 508, and a stepwise guide 601 from upstream toward downstream in this order downstream of the printing head 505 and upstream of the winding flange 509. The loop lower surface pass guide 508 is a cantilever flap that can be turned on a shaft extending on the sheet conveyance path in the widthwise direction. The stepwise guide 601 has a stepwise cross section which is laterally symmetric and is high at both edges whereas low at the center, as viewed in the conveyance direction of the continuous sheet S.

FIGS. 2A to 2D are cross-sectional views explanatory of sheet feeding, printing, and winding processes to be performed by the printing apparatus.

Figure 2A:
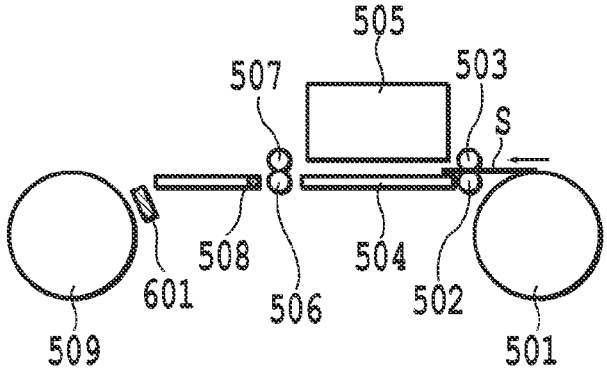
FIG. 2A is a cross-sectional view showing operation during a meander correction in the first preferred embodiment.
Figure 2B:
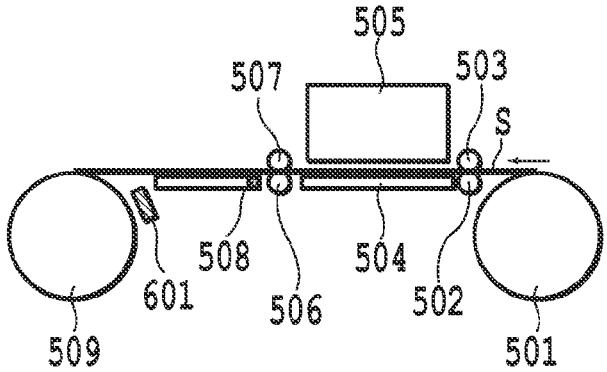
FIG. 2B is another cross-sectional view showing operation during the meander correction in the first preferred embodiment.

First of all, the continuous sheet S wound in a roll around the sheet feeding flange 501 is conveyed downstream by the sheet feeding roller 502 (see FIG. 2A).

A print is made on the conveyed continuous sheet S by the printing head 505 while the continuous sheet S is further conveyed toward the winding flange 509 by the loop roller 506. Thereafter, the tip of the continuous sheet S is nipped by a clamp roller, not shown, housed inside of a unit in the winding flange 509 (see FIG. 2B).

Subsequently, the loop lower surface pass guide 508 is turned, so that a space required for forming a loop is secured between the loop roller 506 and the winding flange 509 and under the straight conveyance path for the continuous sheet S (see FIG. 2C).

Figure 2C:
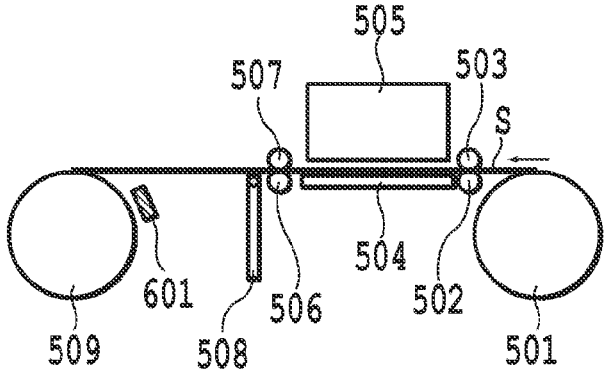
FIG. 2C is a further cross-sectional view showing operation during the meander correction in the first preferred embodiment.
Figure 2D:
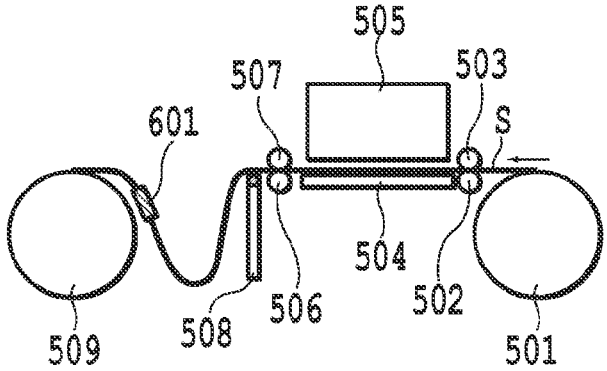
FIG. 2D is a still further cross-sectional view showing operation during the meander correction in the first preferred embodiment.

Thereafter, the loop roller 506 and the sheet feeding roller 502 are rotated in synchronism with each other, and thus, the continuous sheet S sags in a loop in the space secured in the process shown in FIG. 2C. At this time, the continuous sheet S is brought into contact with the stepwise guide 601 and reaches a guide region in the stepwise guide 601. The looped sag is formed while the guide is operated, so that the continuous sheet can be conveyed with high straightness. The high straightness of the continuous sheet S is kept while the continuous sheet S on which a print is made (i.e., a printout) is wound by the winding flange 509 at a conveyance speed equal to that of the loop roller 506 so as to keep the looped sag (see FIG. 2D).

Figure 3A:
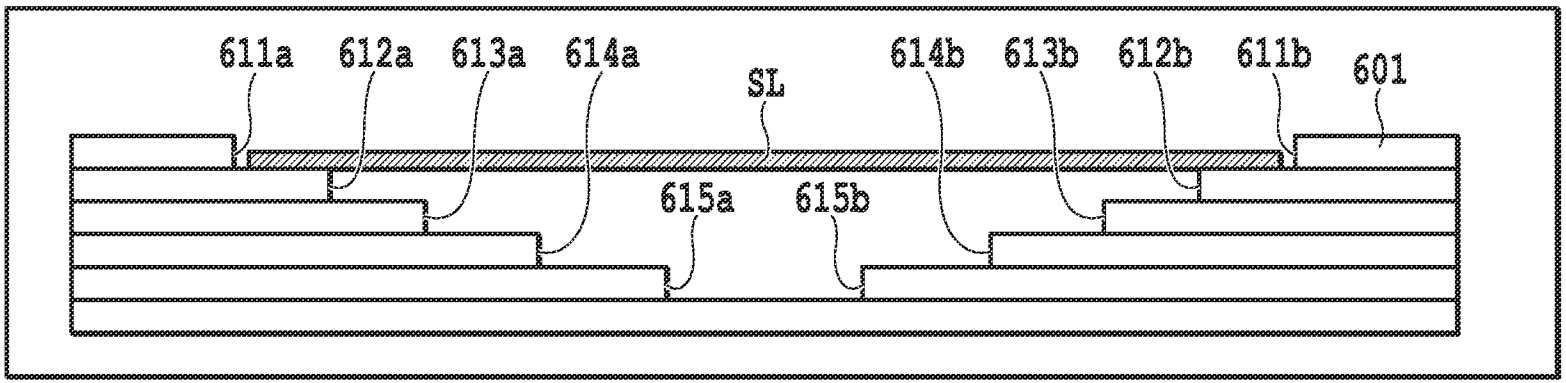
FIG. 3A is a cross-sectional view showing the positional relationship of a stepwise guide according to a sheet width in the first preferred embodiment.

FIGS. 3A and 35 are cross-sectional views showing the stepwise guide 601, as viewed from upstream in the conveyance direction of the continuous sheet.

The stepwise guide 601 is a meander correcting guide having a stepwise cross section that is laterally symmetric and is high at both edges whereas low at the center, as viewed in the conveyance direction of the continuous sheet. The stepwise guide 601 can positionally restrict the sheet in the widthwise direction during the conveyance according to the width of the continuous sheet.

The stepwise guide 601 is provided with a plurality of pairs of opposite guide faces for guiding right and left side edges of the continuous sheet. A first pair of guide faces 611*a* and 611*b* having the same height, located at the highest position in FIG. 3A is adapted to guide the right and left side edges of a widest continuous sheet SL that can be conveyed in the apparatus. Another pair of guide faces 612*a* and 612*b*, a further pair of guide faces 613*a* and 613*b*, a still further pair of guide faces 614*a* and 614*b*, and a still further pair of guide faces 615*a* and 615*b* are disposed at lower positions in this order, and lower pairs of guide faces guide narrower continuous sheets at both side edges of the sheets.

That is to say, the continuous sheet can sag in a loop, to reach the guide region defined between the opposite guide faces (e.g., 613*a* and 613*b*) in paired steps (i.e., guide members) in the stepwise guide. In this manner, one side edge of the continuous sheet is pressed against either one of the opposite guide faces in the paired steps (i.e., the guide members), so that the skewing of the continuous sheet (i.e., the conveyance of the sheet inclined with respect to the original conveyance direction) is corrected. This skewing correction with respect to both of the side edges of the continuous sheet can suppress a phenomenon in which the sheet is repeatedly skewed alternately rightward and leftward with respect to the original conveyance direction, that is, a sheet meander. The width of the continuous sheet is greater than the distance (i.e., the width of the guide region) between the opposite guide faces at next paired steps (i.e., guide members) in the stepwise guide. Therefore, the continuous sheet cannot be held between the opposite guide faces on the next paired steps (i.e., the guide members).

When printing is performed on the continuous sheet SL having the greatest width, for example, out of continuous sheets that can be used in the printing apparatus, the uppermost guide face pair 611*a* and 611*b* in the stepwise guide 601 guides the continuous sheet, while in contact with the side edges of the continuous sheet, thereby suppressing a meander (see FIG. 3A). In contrast, when printing is performed on a continuous sheet SS having the smallest width, for example, out of the continuous sheets that can be used in the printing apparatus, the lowermost guide face pair 615*a* and 615*b* in the stepwise guide 601 functions to thus correct the meander (see FIG. 35).

In the above-described first preferred embodiment, the stepwise guide that is disposed downstream of the looped sag of the sheet and is adapted for the width of the sheet positionally restricts the sheet in the widthwise direction in synchronism with the formation of the looped sag of the sheet, thus ensuring an excellent meander correcting function.

In the above-described first preferred embodiment, it is unnecessary to change a guide according to a sheet width (i.e., the apparatus is maintenance-free), thus providing the sheet conveyance apparatus having a high operability and being capable of reducing a conveyance error caused by an assembling error.

In this manner, in the first preferred embodiment, the guide faces corresponding to the different widths and being formed at the different positions are provided for guiding the side edges of the various printing mediums (i.e., the continuous sheets) having the different widths. For example, assuming that the guide face 611*a* is referred to as a first guide face whereas the guide face 615*a* is referred to as a second guide face, the first guide face 611*a* guides the side edge of the continuous sheet SL having a first width whereas the second guide face 615*a* guides the side edge of the continuous sheet SS having a second width smaller than the first width. The first guide face 611*a* and the second guide face 615*a* are shifted from each other both in the thickness direction of the printing mediums to be guided (i.e., vertically in FIGS. 3A and 3B) and in the widthwise direction, and therefore, they can guide only the printing medium having the corresponding width. The second guide face 615*a* is shifted from the first guide face 611*a* in the direction in which the continuous sheet further sags in the thickness direction of the continuous sheet to be guided.

Although the number of steps in the stepwise guide (i.e., the number of guide regions) is set to five in the first preferred embodiment, it is not limited to this according to the present invention, and therefore, the number of steps in the stepwise guide (i.e., the number of guide regions) may be set according to the number of various widths of the continuous sheets for use in the printing apparatus.

Figure 3B:
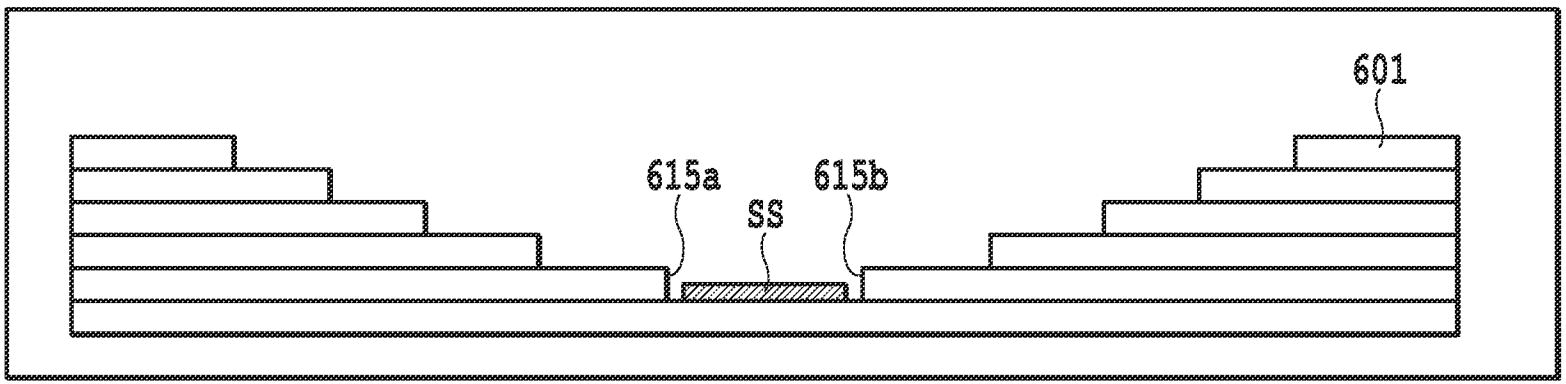
FIG. 3B is another cross-sectional view showing the positional relationship of the stepwise guide according to a sheet width in the first preferred embodiment.

In the first preferred embodiment, the opposite guide faces of the paired steps (i.e., the guide members) in the stepwise guide are disposed vertically with respect to the upper face of the step in the stepwise guide having the stepwise cross section, as viewed in the conveyance direction of the continuous sheet (see FIGS. 3A and 3B). However, the shape of the stepwise guide is not limited to this according to the present invention as long as the sheet can be held between the steps according to the sheet width. For example, the opposite guide faces of the paired steps (i.e., the guide members) may be inversely tapered toward an opening end so as to allow the sheet to be readily held therebetween.

In the above-described first preferred embodiment, the distance (i.e., the width of the guide region) between the opposite guide faces of the paired steps (i.e., the guide members) in the stepwise guide has been set according to the sheet width. According to the present invention, the distance (i.e., the width of the guide region) between the opposite guide faces of the paired steps (i.e., the guide members) in the stepwise guide may be set greater than the sheet width according to the allowable degree of the skewing or meander of the sheet.

In the above-described first preferred embodiment, the stepwise guide has had the stepwise cross section that is laterally symmetric and is high at both edges whereas low at the center, as viewed in the conveyance direction of the continuous sheet. However, the shape of the stepwise guide according to the present invention is not limited to this as long as the stepwise guide can positionally restrict the sheet in the widthwise direction during the conveyance according to the width of the continuous sheet. For example, the shape of the stepwise guide may be laterally asymmetric, as viewed in the conveyance direction of the continuous sheet, according to an installation position in the widthwise direction of the conveyance path of the roll for unrolling the continuous sheet: for example, only either of right and left faces may be stepwise.

Second Preferred Embodiment

Hereinafter, a description will be given of a printing apparatus in a second preferred embodiment according to the present invention. A printing apparatus in the present preferred embodiment is a high speed line printer adopting an ink jet system that can be adapted for both simplex printing and duplex printing by the use of a continuous sheet wound in a roll. For example, the high speed line printer is suitable for printing a large number of sheets in a print laboratory or the like. The present invention is widely applicable to printing apparatuses such as a printer, a multifunction printer, a copying machine, a facsimile, and a fabricating apparatus for various devices. Moreover, the present invention is applicable to a sheet processing apparatus for performing not only printing but also various kinds of processing (converting, coating, irradiating, reading, inspecting, and the like) on a roll of sheet.

Figure 4:
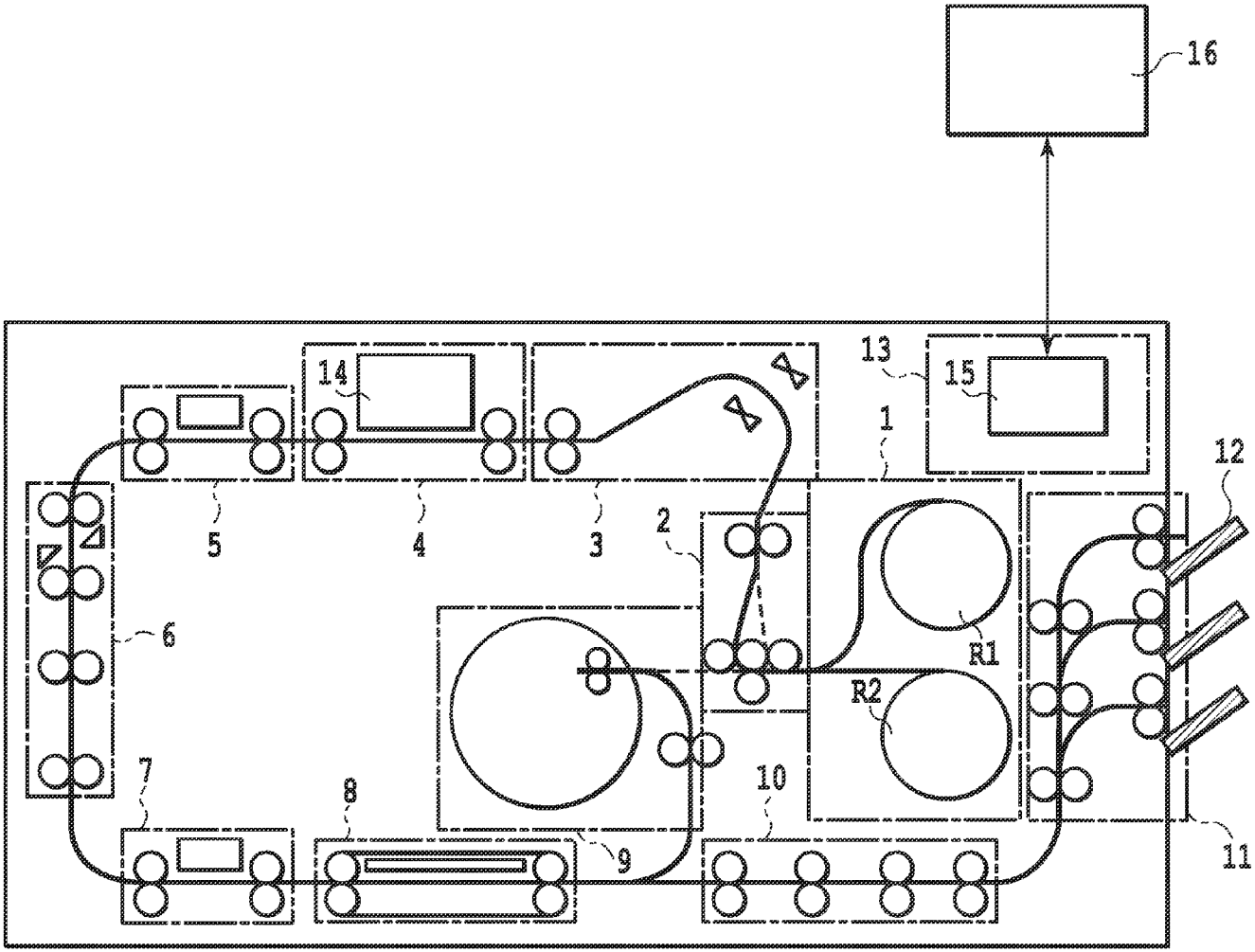
FIG. 4 is a schematic view showing the inside configuration of a printing apparatus according to a second preferred embodiment.

FIG. 4 is a cross-sectional view schematically showing the inside configuration of a printing apparatus. The printing apparatus in the present preferred embodiment can print on both of a first surface and a second surface at the reverse of the first surface of a continuous sheet wound in a roll in a duplex print mode. The printing apparatus houses therein mainly units such as a sheet feeding unit 1, a de-curling unit 2, a skewing correcting unit 3, a printing unit 4, an inspecting unit 5, a cutting unit 6, an information recording unit 7, a drying unit 8, a sheet winding unit 9, a discharging/conveying unit 10, a sorting unit 11, a discharging unit 12, and a controlling unit 13. A sheet is conveyed along a sheet conveyance path indicated by a solid line in FIG. 4 by a conveyance mechanism including roller pairs and belts, to be thus processed in each of the units. In the present preferred embodiment, at an arbitrary position on the sheet conveyance path, a side near the sheet feeding unit 1 is referred to as "upstream": in contrast, the opposite side is referred to as "downstream."

The sheet feeding unit 1 is adapted to accommodate and feed the continuous sheet wound in a roll. The sheet feeding unit 1 can hold two rolls R1 and R2 and is configured to draw and feed a sheet from either one of the rolls. Here, the number of rolls that can be accommodated is not limited to two but may be one or three or more.

The de-curling unit 2 is designed to reduce curl (i.e., a warp) of a sheet fed from the sheet feeding unit 1. The de-curling unit 2 allows the sheet to pass therethrough in a curve in such a manner as to apply a warp reverse to the curl by a de-curling force by using a couple of pinch rollers with respect to a single drive roller, thereby reducing the curl.

The skewing correcting unit 3 is adapted to correct skewing of the sheet having passed the de-curling unit 2. The side edge of the sheet on a reference side is pressed against a guide member in the skewing correcting unit 3, and therefore, the skewing of the sheet is corrected. This operation is performed with respect to both side edges of the sheet, thereby preventing the sheet from meandering.

The printing unit 4 is adapted to print on the sheet to be conveyed by a printing head 14 serving as a printing device, thereby forming an image on the sheet. The printing unit 4 is provided with a plurality of conveyance rollers for conveying the sheet. The printing head 14 is a line type printing head having a nozzle array of an ink jet system within a range that covers a maximum width of a sheet to be used. The printing unit 4 includes a plurality of printing heads juxtaposed in a sheet conveyance direction. In the present preferred embodiment, there are seven printing heads corresponding to C (cyan), M (magenta), Y (yellow), LC (light cyan), LM (light magenta), G (gray), and K (black) colors. Here, the number of ink colors and the number of printing heads are not limited to seven. A system using heat generating elements, a system using piezoelectric elements, a system using electrostatic elements, a system using MEMS elements, and the like can be adopted as the ink jet system. Ink of each of the colors is supplied to the printing head 14 through an ink tube from an ink tank.

The inspecting unit 5 is designed to optically scan an inspection pattern or an image printed on the sheet in the printing unit 4 so as to inspect the state of the nozzles in the printing head, a sheet conveyed state, an image position, and the like, thereby determining whether or not the image has been accurately printed. A scanner includes a CCD image sensor or a CMOS image sensor.

The cutting unit 6 is provided with a mechanical cutter for cutting the printed sheet in a predetermined length. The cutting unit 6 includes a plurality of conveyance rollers for feeding out the sheet to a next process.

The information recording unit 7 is designed to record print information (i.e., information inherent to an image) such as a serial number of a printout or a printing date of a printing operation at the reverse of the cut sheet.

The drying unit 8 is designed to heat the sheet printed in the printing unit 4 so as to dry the applied ink in a short period of time. Inside of the drying unit 8, hot air is blown to at least an ink applied surface, that is, the lower surface of the passing sheet, thereby drying the ink applied surface. Incidentally, the drying system is not limited to the system in which the hot air is blown from at least the lower surface side. Therefore, the sheet surface may be irradiated with an electromagnetic wave (such as an ultraviolet ray or an infrared ray). The drying unit 8 includes a conveyance belt and a conveyance roller for feeding out the sheet to a next process.

A sheet conveyance path from the sheet feeding unit 1 to the drying unit 8 is referred to as a first path. The first path is formed into a U shape from the printing unit 4 to the drying unit 8 inside of the printing apparatus, wherein the cutting unit 6 is located in the middle of the U shape. A path from the drying unit 8 to the printing unit 4 through the de-curling unit 2 (i.e., a loop path) is referred to as a second path, for feeding the sheet having passed the drying unit 8 to the printing unit 4 again.

The sheet winding unit 9 temporarily winds the continuous sheet on the obverse of which a print is made during a duplex printing operation, to reverse the sheet. The sheet winding unit 9 is disposed on the way of the above-described second path. The sheet winding unit 9 includes a winding rotary member (i.e., a winding drum) for winding the sheet. The continuous sheet on the obverse (i.e., first surface) of which a print has been made but which has not been cut is temporarily wound around the winding drum. After the sheet is wound, the winding drum is reversely rotated, and then, the wound sheet is fed out to the de-curling unit 2 in the order reverse to that when the sheet is wound, and further, to the printing unit 4. This sheet is reversed, and therefore, a print can be made on the reverse (i.e., second surface) of the continuous sheet in the printing unit 4. The duplex printing operation will be specifically described later.

The discharging/conveying unit 10 is adapted to convey the sheet that has been cut in the cutting unit 6 and dried in the drying unit 8, and then, to deliver the sheet to the sorting unit 11. The discharging/conveying unit 10 is disposed on a path different from the second path, on which the sheet winding unit 9 is disposed (hereinafter referred to as a third path). In order to selectively guide the sheet conveyed on the first path onto either one of the second path and the third path, a path switching mechanism having a movable flap is disposed at a branching position between the paths.

The sorting unit 11 and the discharging unit 12 are disposed at the side of the sheet feeding unit 1 and at the end of the third path. The sorting unit 11 is adapted to sort the printed sheets into groups and discharge them to the different trays in the discharging unit 12, as required. The sorted sheets are discharged onto the discharging unit 12 including a plurality of trays. In this manner, the third path has a layout in which the sheet is discharged under the sheet feeding unit 1 onto a side opposite to the printing unit 4 and the drying unit 8 with respect to the sheet feeding unit 1 inside of the printing apparatus.

As described above, the first path extends from the sheet feeding unit 1 to the drying unit 8 in order. Upstream of the drying unit 8, the first path is branched into the second path and the third path. The sheet winding unit 9 is disposed on the way of the second path, which is then converged with the first path. The discharging unit 12 is disposed at the end of the third path.

The controlling unit 13 is responsible for controlling each of the units in the entire printing apparatus. The controlling unit 13 includes a controller 15 including a CPU, memories, and various I/O interfaces, and a power source. The operation of the printing apparatus is controlled in response to an instruction from the controller 15 or external equipment (a host apparatus) 16 such as a host computer connected to the controller 15 via the I/O interface.

Figure 5:
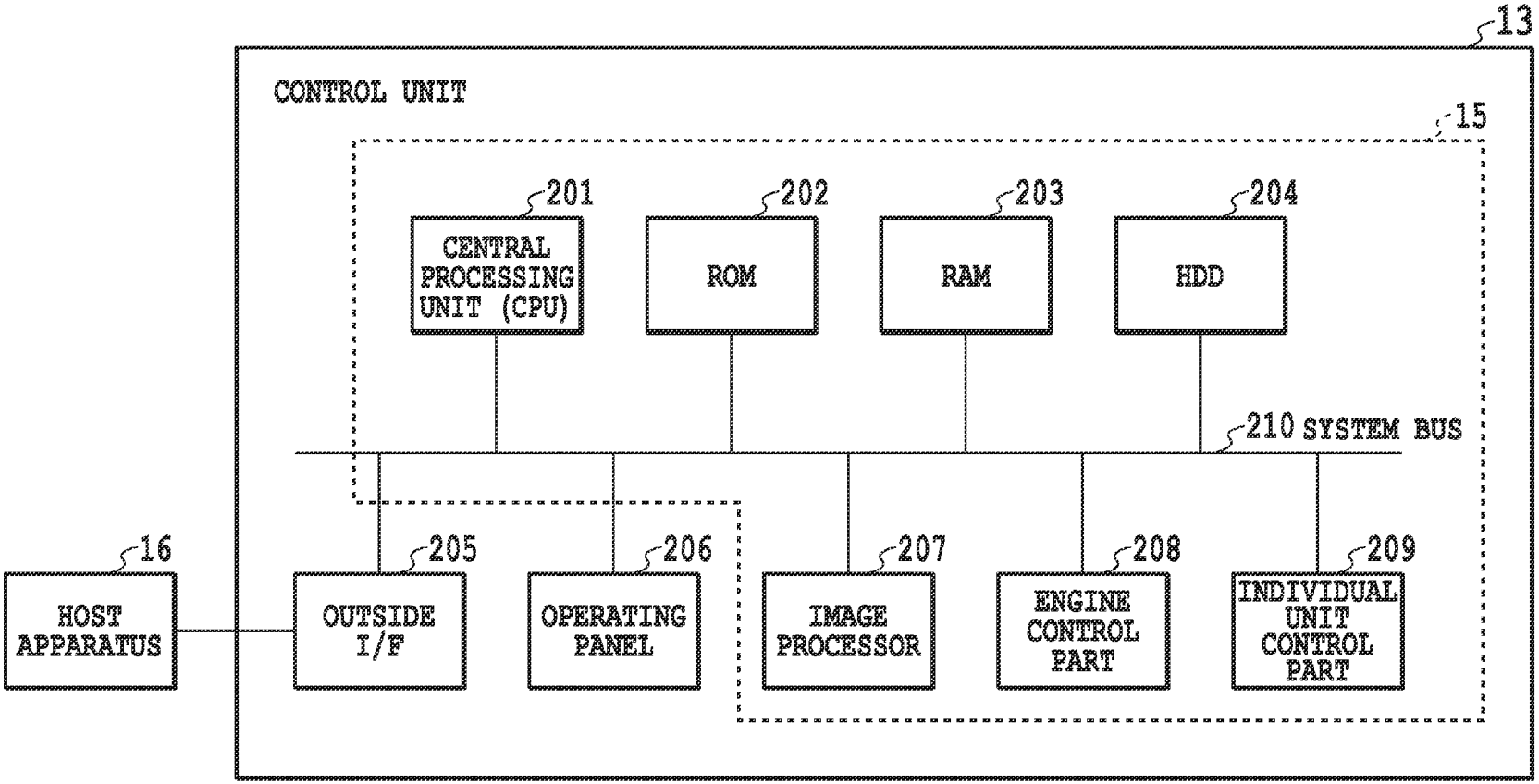
FIG. 5 is a block diagram conceptually illustrating a control unit 13 in the second preferred embodiment.

FIG. 5 is a block diagram illustrating the idea of the controlling unit 13. The controller (surrounded by a broken line) 15 included in the controlling unit 13 is constituted of a CPU 201, a ROM 202, a RAM 203, an HDD 204, an image processor 207, an engine control part 208, and an individual unit control part 209. The CPU 201 (abbreviating a central processing unit) comprehensively controls the operation of each of the units in the printing apparatus. The ROM 202 stores therein programs to be executed by the CPU 201 and stationary data required for various operations in the printing apparatus. The RAM 203 is used as a work area for the CPU 201, a temporary storage area for various received data, or a storage area for various setting data. The programs to be executed by the CPU 201, print data, and setting information required for various operations in the printing apparatus can be stored in and read from the HDD 204 (abbreviating a hard disk drive).

An operating panel 206 serves as an input/output interface with respect to a user, and includes an input such as a hard key or a touch panel and an output such as a display presenting information or a voice generator.

The units requiring quick data processing include dedicated processors. The image processor 207 performs image processing of the print data to be processed in the printing apparatus. The image processor 207 converts the color space (e.g., YCbCr) of the input image data into a standard ROB color space (e.g., sRGB). Moreover, the image processor 207 processes the image data for various kinds of image processing such as resolution conversion, an image analysis, and image correction, as required. The print data resulting from the image processing is stored in the RAM 203 or the HDD 204. The engine control part 208 controls driving of the printing head 14 in the printing unit 4 according to the print data in response to a control command output from the CPU 201 or the like. The engine control part 208 further controls a conveyance mechanism in each of the units inside of the printing apparatus. The individual unit control part 209 serves as a sub controller for individually controlling each of the sheet feeding unit 1, the de-curling unit 2, the skewing correcting unit 3, the inspecting unit 5, the cutting unit 6, the information recording unit 7, the drying unit 8, the sheet winding unit 9, the discharging/conveying unit 10, the sorting unit 11, and the discharging unit 12. The individual unit control part 209 controls the operation of each of the units in response to an instruction from the CPU 201. The outside I/F 205 is an interface (abbreviated as an I/F) for connecting the controller 15 to the host apparatus 16 serving as the external equipment, wherein the outside I/F 205 is a local I/F or a network I/F. The above-described constituent elements are connected to each other via a system bus 210.

The host apparatus 16 functions as a source for supplying image data that allows the printing apparatus to perform a printing operation. The host apparatus 16 may be a versatile or dedicated computer or dedicated image equipment such as an image capture having an image reader unit, a digital camera, and a photo storage. When the host apparatus 16 is a computer, the OS, application software for producing image data, and a printer driver for the printing apparatus are installed in a storage device included in the computer. Software need not implement all of the above-described processing, but hardware may implement some or all of the above-described processing.

Next, a description will be given of basic printing operations. The printing operations are performed in a simplex print mode and a duplex print mode. The operations in the simplex print mode and the duplex print mode are different from each other, and therefore, explanation will be individually made on the operations in the modes.

Figure 6:
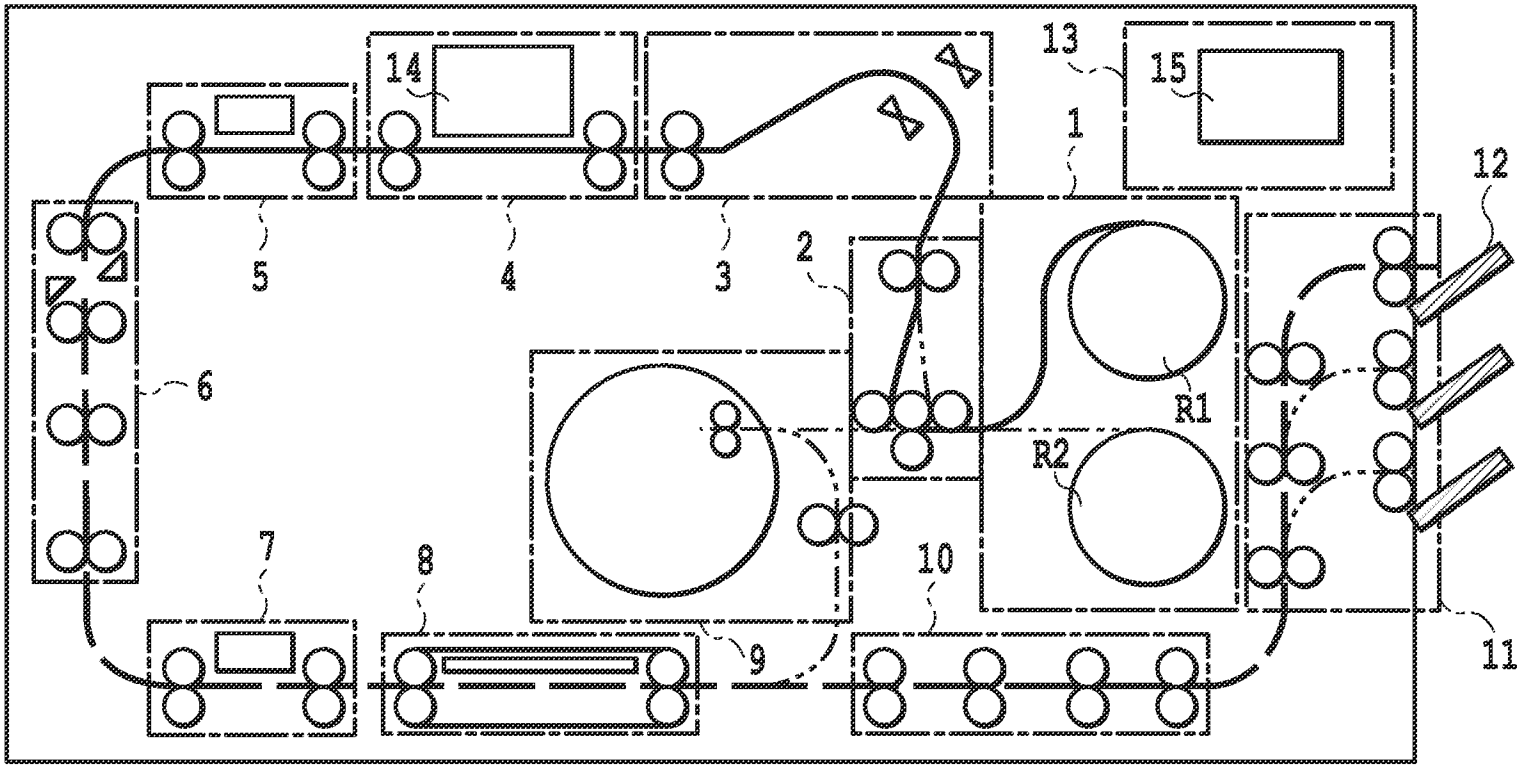
FIG. 6 is a view explanatory of operation during simplex printing in the second preferred embodiment.

FIG. 6 is a view explanatory of operation during the simplex printing. A conveyance path, on which printing is performed on the sheet fed from the sheet feeding unit 1 and from which the sheet after printing is discharged onto the discharging unit 12, is indicated by a bold line. Printing is performed on the obverse (i.e., the first surface) of the sheet that has been fed from the sheet feeding unit 1 and processed in each of the de-curling unit 2 and the skewing correcting unit 3 in the printing unit 4. Images, each having a predetermined unit length in a conveyance direction, (i.e., unit images) are subsequently printed on the elongated continuous sheet, and thus, a plurality of images are formed in arrangement. The printed sheet passes the inspecting unit 5, and then, is cut per unit image in the cutting unit 6. The print information is recorded on the reverse of the cut sheet in the information recording unit 7, as required. The cut sheets are conveyed one by one to the drying unit 8, followed by drying. Thereafter, the cut sheets pass the discharging/conveying unit 10, are sorted in the sorting unit 11, as required, and then, are sequentially discharged to and stacked on the tray in the discharging unit 12. In the meantime, after the sheet having the last unit image is cut in the cutting unit 6, the continuous sheet remaining in the printing unit is returned to the sheet feeding unit 1, and then, is wound around the roll R1 or R2.

In this manner, in the simplex print mode, the sheet is processed on the first path and the third path, but does not pass the second path. To sum up, the control unit 13 controls the printing operation in the simplex print mode according to the following sequences (1) to (6):

(1) feeding a sheet from the sheet feeding unit 1 to the printing unit 4;

(2) repeatedly printing unit images on the first surface of the fed sheet in the printing unit 4;

(3) repeatedly cutting the sheet in the cutting unit 6 per unit image printed on the first surface;

(4) allowing the sheets cut per unit image to pass the drying unit 8 one by one;

(5) discharging the sheets having passed the drying unit 8 one by one to the discharging unit 12 through the third path; and cutting off the sheet having the last unit image, before returning the sheet remaining in the printing unit 4 to the sheet feeding unit 1.

Figure 7:
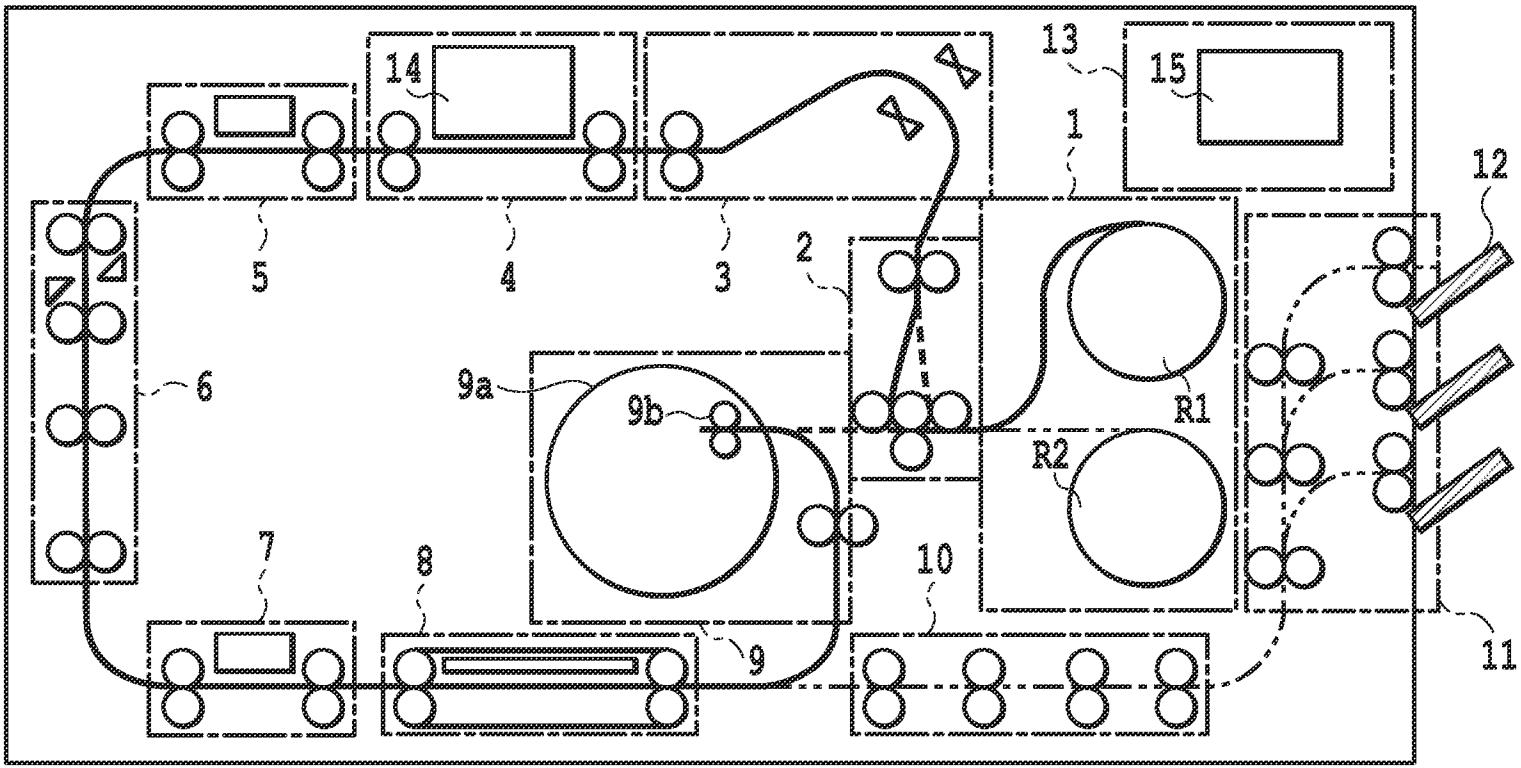
FIG. 7 is a view explanatory of operation during duplex printing in the second preferred embodiment.

FIG. 7 is a view explanatory of operation during the duplex printing. In the duplex print mode, a reverse print sequence follows the obverse print sequence. The respective operations in the sheet feeding unit 1 to the inspecting unit 5 in the preceding obverse print sequence are identical to those in the above-described simplex print mode. The continuous sheet is not cut in the cutting unit 6, and therefore, it is conveyed to the drying unit 8 as it remains continuous. After the ink applied onto the obverse is dried in the drying unit 8, the sheet is guided not onto the path on the side of the discharging/conveying unit 10 (i.e., the third path) but onto the path on the side of the sheet winding unit 9 (i.e., the second path). The leading end of the sheet introduced onto the second path is held by a roller pair 9*b* disposed in a winding drum 9*a* in the sheet winding unit 9. While the leading end of the sheet is held by the roller pair 9*b*, the winding drum 9*a* is rotated forward (i.e., counterclockwise in FIG. 7), and then, the sheet is wound around the winding drum 9*a*. Upon completion of all of the planned printing operations on the obverse in the printing unit 4, the trailing end of the printing region of the continuous sheet is cut in the cutting unit 6. The entire continuous sheet downstream in the conveyance direction (i.e., the printed side) with reference to the cut position is wound up to the trailing end (i.e., the cut position) in the sheet winding unit 9 through the drying unit 8. In the meantime, the continuous sheet staying upstream in the conveyance direction (i.e., on the side of the printing unit 4) with reference to the cut position is returned to the sheet feeding unit 1 in such a manner that the leading end (i.e., the cut position) of the sheet does not remain in the de-curling unit 2, and then, is rewound around the roll R1 or R2. This rewinding (i.e., back feeding) prevents the sheet that is wound around the roll R1 or R2 and fed from the sheet feeding unit 1 from colliding against the sheet that is fed again from the sheet winding unit 9 in the following reverse print sequence.

The above-described obverse print sequence is switched to the reverse print sequence. The winding drum 9*a* in the sheet winding unit 9 is rotated in a direction reverse to that at the time of winding (clockwise in FIG. 7). The end of the wound sheet (the trailing end of the sheet during winding serves as the leading end of the sheet during feeding) is fed into the de-curling unit 2 along a path indicated by a broken line in FIG. 7. The de-curling unit 2 corrects curl that has been exerted on the sheet by the winding rotary member. In other words, the de-curling unit 2 is positioned between the sheet feeding unit 1 and the printing unit 4 on the first path, and further, between the sheet winding unit 9 and the printing unit 4 on the second path. Thus, the de-curling unit 2 is common between both of the paths. The de-curling unit 2 de-curls the sheet in the orientation reverse to the preceding de-curling. At this time, the sheet on the conveyance path inside of the de-curling unit is reverse to that in the obverse printing sequence. Thereafter, the continuous sheet passes through the skewing correcting unit 3 and printing is performed on the reverse of the continuous sheet in the printing unit 4. The printed continuous sheet is cut per unit image in the cutting unit 6 through the inspecting unit 5. This cutting operation turns the continuous sheet into cut sheets (i.e., printouts) having the unit images printed on the obverse and reverse thereof. The images are printed on both sides of the cut sheet, and therefore, the information recording unit 7 does not record any information. The cut sheets are conveyed one by one to the drying unit 8 and the discharging/conveying unit 10, are sorted in the sorting unit 11, as required, and then, are sequentially discharged to and stacked on the tray in the discharging unit 12.

In this manner, the sheet is processed on the first path, the second path, the first path, and the third path in this order in the duplex print mode. To sum up, the control unit 13 controls the printing operation in the duplex print mode according to the following sequences (1) to (11):

(1) feeding a sheet from the sheet feeding unit 1 to the printing unit 4;

(2) repeatedly printing unit images on the first surface of the fed sheet in the printing unit 4;

(3) allowing the sheet having the image printed on the first surface thereof to pass the drying unit 8;

(4) introducing the sheet having passed the drying unit 8 onto the second path, to wind it around the winding rotary member provided in the sheet winding unit 9;

(5) repeatedly printing images on the first surfaces, before cutting the sheet behind the last printed unit image in the cutting unit 6;

(6) winding, around the winding rotary member, the cut and printed sheet until the end of the sheet passes the drying unit 8 and reaches the winding rotary member, and further, returning the sheet remaining on the printing unit 4 side by the cut to the sheet feeding unit 1;

(7) winding the sheet in the sheet winding unit 9, before reversely rotating the winding rotary member so as to feed the sheet onto the second path to the printing unit 4 again;

(8) repeatedly printing, in the printing unit 4, unit images on the second surface of the sheet fed on the second path;

(9) repeatedly cutting, in the cutting unit 6, the sheet per unit image printed on the second surface;

(10) allowing the sheets cut per unit image to pass the drying unit 8 one by one; and discharging the sheets having passed the drying unit 8 one by one to the discharging unit 12 through the third path.

Next, explanation will be made in more details on the skewing correcting unit 3 in the printing apparatus having the above-described configuration.

Figure 8:
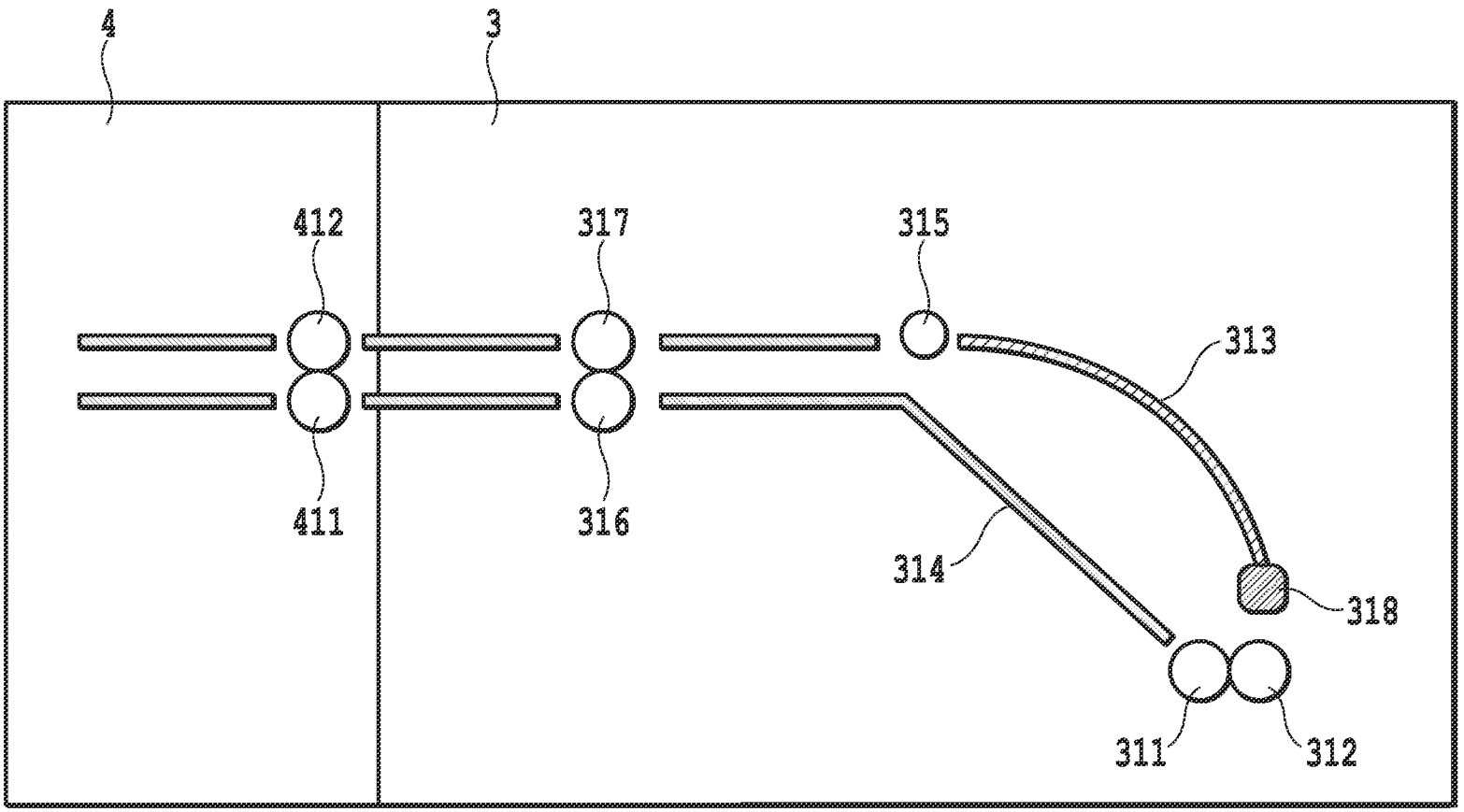
FIG. 8 is a cross-sectional view showing a skewing correcting unit in the second preferred embodiment.
Figure 9:
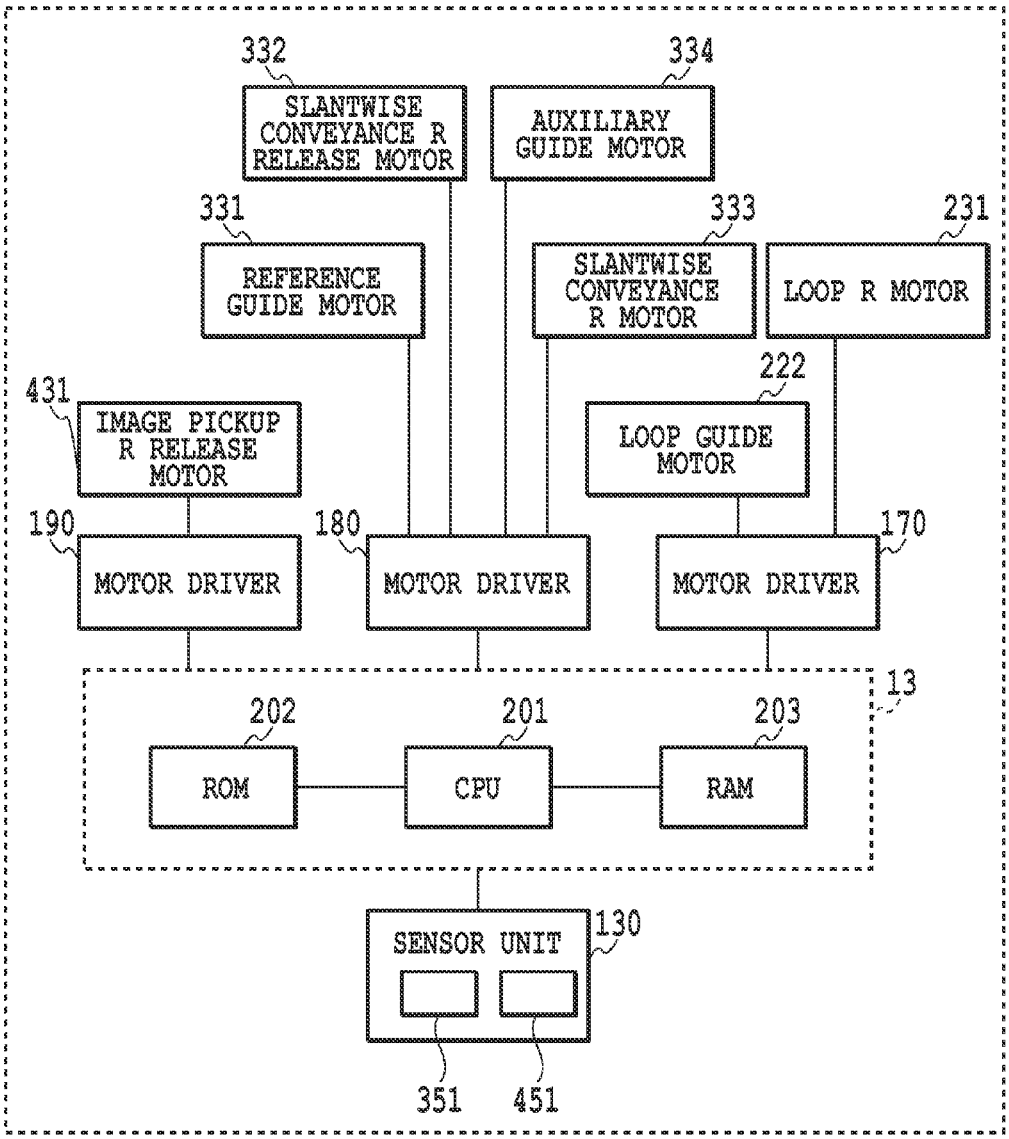
FIG. 9 is a diagram illustrating a controller for the skewing correcting unit in the second preferred embodiment.

FIG. 8 is a diagram illustrating a skewing correcting unit in a second preferred embodiment. FIG. 9 is a control block diagram illustrating the skewing correcting unit.

The skewing correcting unit is provided from upstream to downstream with a first driving roller 311 and a first driven roller 312, and a slantwise conveyance driving roller 316 and a slantwise conveyance driven roller 317. An upper surface guide 313, a stepwise guide 318, a lower surface guide 314, and a roller 315 are interposed between the first driving roller 311 and the slantwise conveyance driving roller 316. Moreover, a reference guide is provided downstream of the slantwise conveyance driving roller 316, although not shown, for allowing the sheet end extending in the sheet conveyance direction to abut against the same to positionally adjust the sheet end reaching the printing unit 4.

The skewing correcting unit includes a sheet conveyance path curved at substantially 90° between the first driving roller 311 and the roller 315. The upper surface guide 313 and the lower surface guide 314 define a part of the conveyance path, on which the sheet is guided downstream of the first driving roller 311. The first driving roller 311 serving as a conveying device (i.e., a first conveying device) is connected to a loop R motor 231 (FIG. 9), and therefore, is driven by the loop R motor 231. The skewing correcting unit has a mechanism for rotating the first driving roller 311 in association with the rotation of the loop R motor 231. The upper surface guide 313 is connected to a loop guide motor 222, and therefore, is driven by the loop guide motor 222. Thus, the skewing correcting unit has a mechanism for opening or closing the surface guide 313 in association with the rotation of the loop guide motor 222. The stepwise guide 318 is attached to the surface guide 313, and therefore, can be moved in synchronism with the opening/closing of the surface guide 313, and further, projects onto the sheet conveyance path when the surface guide 313 is opened.

The slantwise conveyance driving roller 316 serving as a slantwise conveying device is driven to be rotated by a slantwise conveyance R motor 333. In the meantime, the slantwise conveyance driven roller 317 can be moved between a position at which it is brought into press-contact with the slantwise conveyance driving roller 316 and a position at which it is separated from the slantwise conveyance driving roller 316 by a slantwise conveyance R release motor 332 serving as a separating/contacting device. The reference guide, not shown, can be moved in a direction crossing the sheet conveyance direction by a reference guide motor 331. The reference guide is moved to a reference position at the sheet end by the reference guide motor 331, and then, abuts against the side edge of the sheet slantwise conveyed by the slantwise conveyance driving roller 316, thus guiding the side edge of the sheet. In this manner, the sheet end entering the printing unit 4 is positionally adjusted, so that the skewing of the sheet can be corrected.

The printing unit 4 includes a second driving roller 411 (i.e., a second conveying device) and a second driven roller 412 on the upstream side. The second driven roller 412 serving as a conveying device can be moved, by a pickup R release motor 431, between a position at which it is brought into press-contact with the second driving roller 411 and a position at which it is separated from the second driving roller 411.

In FIG. 9, the controller 15 serving as a controlling device mainly controls the above-described printing apparatus. The controller 15 includes the CPU 201, the ROM 202 storing programs, required tables, and other stationary data therein, and the RAM 203 having an image data developing area, a work area, and the like.

A sensor unit 130 includes sensors for detecting the state of the apparatus. In the present preferred embodiment, there are provided not only a first sheet leading end detecting sensor 351 and a second sheet leading end detecting sensor 451 that are adapted to obtain information on the position of the sheet but also a temperature sensor that is adapted to detect an ambient temperature and various sensors, not shown.

A motor drive 170 is designed to drive the loop R motor 231 and the loop guide motor 222. Driving the loop R motor 231 allows the first driving roller 311 to be driven, thus conveying the sheet in the downstream direction. In the meantime, driving the loop guide motor 222 permits the upper surface guide 313 to be opened or closed.

Another motor drive 180 is adapted to drive the slantwise conveyance R motor 333, an auxiliary guide motor 334, the slantwise conveyance R release motor 332, and the reference guide motor 331. Driving the slantwise conveyance R motor 333 allows the slantwise conveyance driving roller 316 to be driven, thus slantwise conveying the sheet to the reference guide. Moreover, driving the slantwise conveyance R release motor 332 permits the slantwise conveyance driven roller 317 to be brought into or out of contact with the slantwise conveyance driving roller 316. Additionally, driving the reference guide motor 331 allows the reference guide to abut against the sheet end on the side on which the reference guide is disposed.

A further motor driver 190 drives the pickup R release motor 431. Driving the pickup R release motor 431 permits the second driven roller 412 to be brought into or out of contact with the second driving roller 411.

FIGS. 10A to 10D are cross-sectional views explanatory of conveyance modes in the skewing correcting unit, respectively.

Figure 10A:
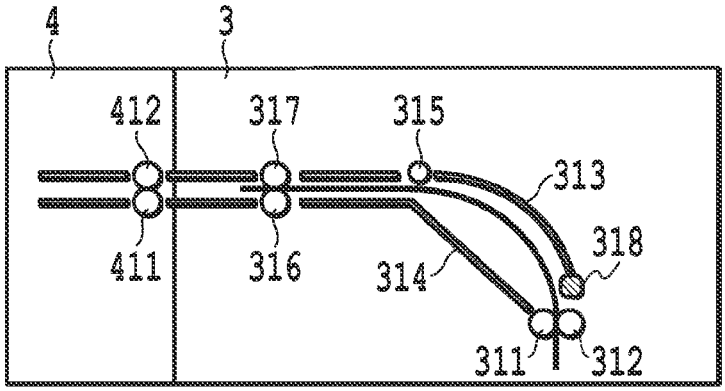
FIG. 10A is a cross-sectional view showing the skewing correcting unit in a conveyance mode in the second preferred embodiment.

In a sheet feeding mode shown in FIG. 10A, the upper surface guide 313 is closed. The sheet is conveyed until the leading end of the sheet is nipped between the slantwise conveyance driving roller 316 and the slantwise conveyance driven roller 317.

Figure 10B:
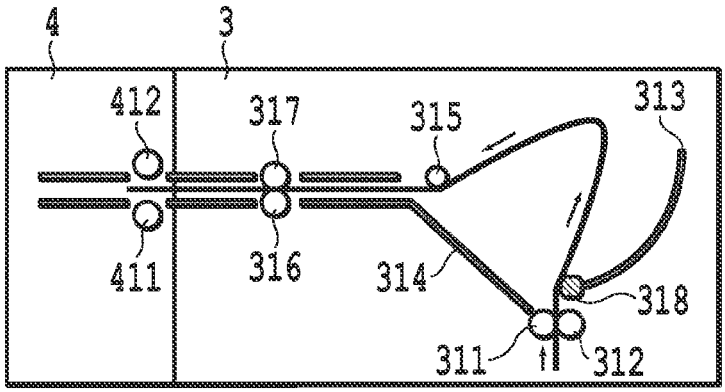
FIG. 10B is a cross-sectional view showing the skewing correcting unit in another conveyance mode in the second preferred embodiment.
Figure 10C:
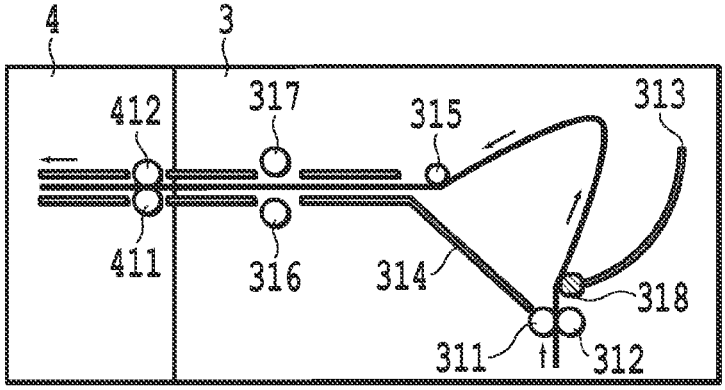
FIG. 10C is a cross-sectional view showing the skewing correcting unit in a further conveyance mode in the second preferred embodiment.

In a skewing correction mode shown in FIG. 10B, the sheet is nipped by the slantwise conveyance driven roller 317 in the sheet feeding mode shown in FIG. 10A, and then, the upper surface guide 313 is opened, thereby forming a looped sag in the sheet. For example, the upper surface guide 313 is opened, before the second driving roller 411 is stopped whereas the first driving roller 311 is rotated, so that the looped sag can be formed in the sheet. Thereafter, the sheet is conveyed by driving the slantwise conveyance driving roller 316, and thus, the sheet end abuts against the reference guide, not shown, to be positionally adjusted. At this time, the stepwise guide 318 projects onto the sheet conveyance path in association with the operation of the upper surface guide 313, thereby positionally restricting the sheet in the widthwise direction.

In a normal print mode shown in FIG. 100, the printing unit 4 performs the printing operation in synchronism with the operation of the second driving roller 411 while keeping the looped sag in the sheet. At this time, the stepwise guide 318 projects onto the sheet conveyance path, to positionally restrict the sheet in the widthwise direction, so that the meander of the sheet is corrected upstream of the looped sag.

Figure 10D:
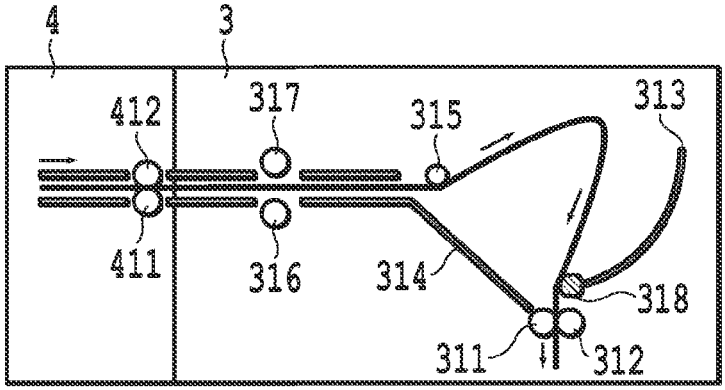
FIG. 10D is a cross-sectional view showing the skewing correcting unit in a still further conveyance mode in the second preferred embodiment.

In a rewinding mode shown in FIG. 10D, the first driving roller 311 and the second driving roller 411 are rotated in a direction (i.e., a second direction) reverse to the conveyance direction in the normal print mode shown in FIG. 100 (i.e., a first direction), so that the sheet is rewound to the sheet feeding unit while keeping the looped sag in the sheet. At this time, the stepwise guide 318 projects onto the sheet conveyance path, to positionally restrict the sheet in the widthwise direction, so that the meander of the sheet is corrected during the rewinding operation.

Figure 11:
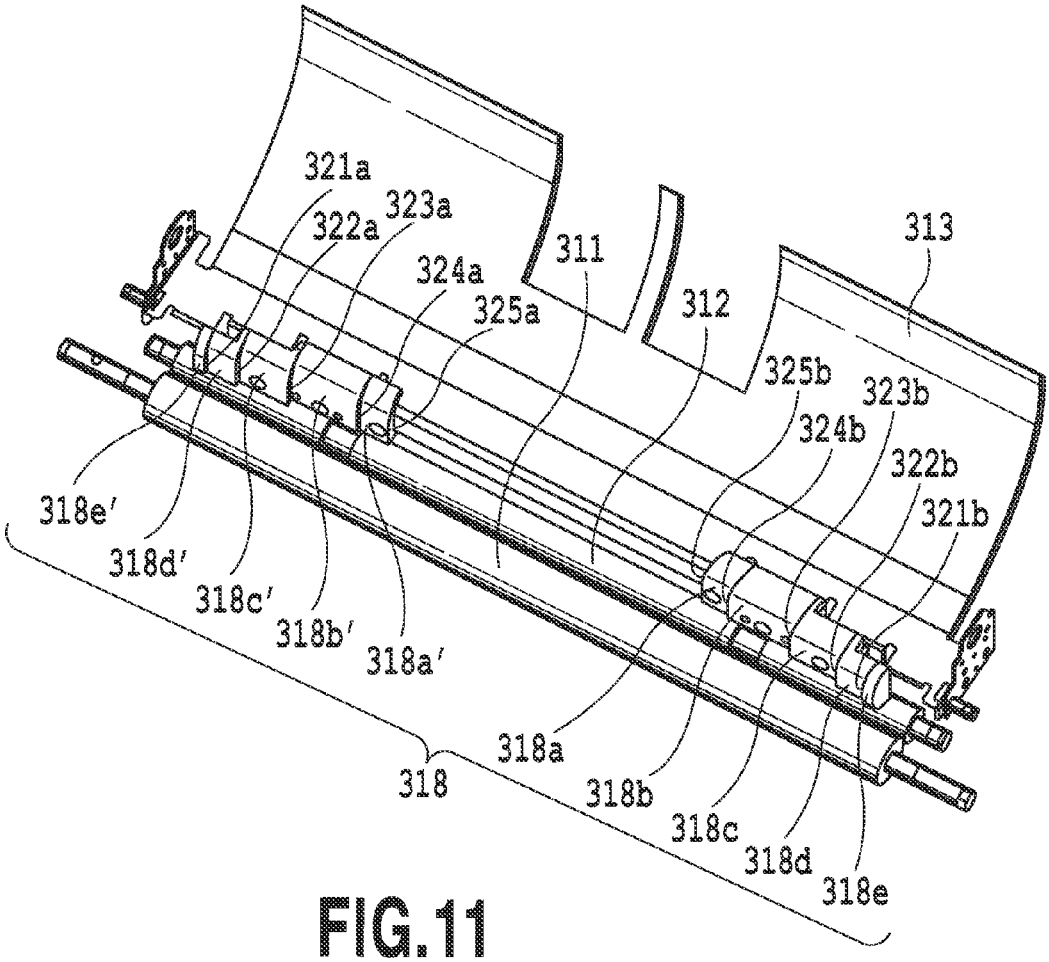
FIG. 11 is a perspective view showing the configuration of a stepwise guide in the second preferred embodiment.
Figure 12A:
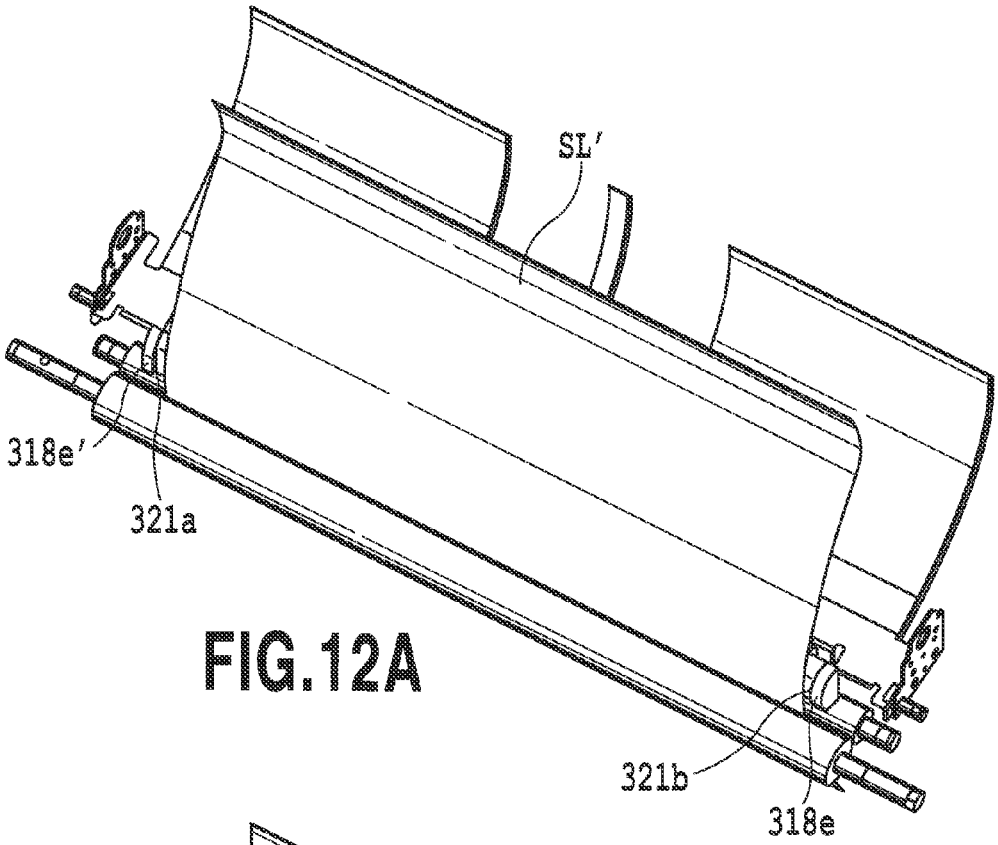
FIG. 12A is a perspective view showing the positional relationship of the stepwise guide according to a sheet width in the second preferred embodiment.
Figure 12B:
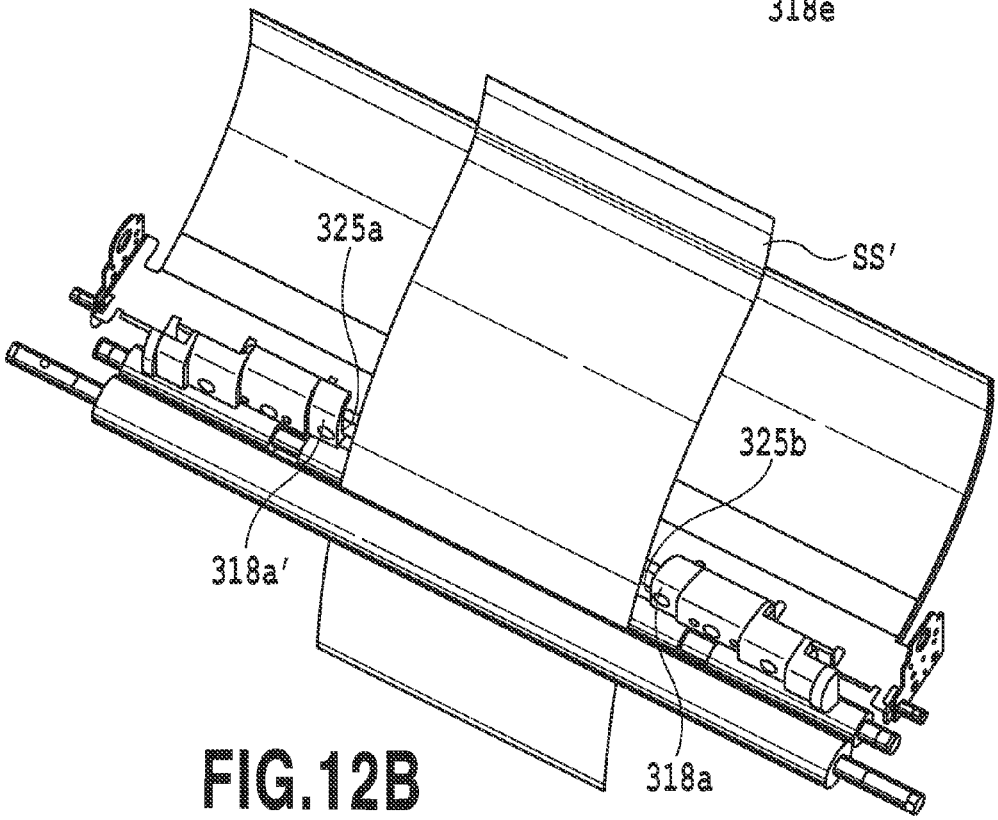
FIG. 12B is another perspective view showing the positional relationship of the stepwise guide according to a sheet width in the second preferred embodiment.

FIG. 11 is a perspective view explanatory of the stepwise guide 318. FIGS. 12A and 12B are perspective views explanatory of the state in which the skewing is corrected by the stepwise guide 318 according to the width of each of the sheets.

The stepwise guide 318 in the second preferred embodiment is adapted for five widths of the sheets. That is to say, the stepwise guide 318 includes guide blocks (i.e., guide members) of five sizes, each of the guide blocks positionally restricting the sheet in the widthwise direction. FIG. 11 shows smallest sheet guide blocks 318*a* and 318*a*', small sheet guide blocks 318*b* and 318*b*', middle sheet guide blocks 318*c* and 318*c*', large sheet guide blocks 318*d* and 318*d*', and largest sheet guide blocks 318*e* and 318*e*'.

The guide blocks 318*a*, 318*b*, 318*c*, 318*d*, and 318*e* have guide faces 325*b*, 324*b*, 323*b*, 322*b*, and 321*b* for guiding the continuous sheet, while in contact with the side edge of the continuous sheet, respectively. Moreover, the guide blocks 318*a*', 318*b*', 318*c*', 318*d*', and 318*e*' have guide faces 325*a*, 324*a*, 323*a*, 322*a*, and 321*a*, respectively. Each of the guide blocks is fixed to the upper surface guide 313, and therefore, actuates in synchronism with the opening/closing of the upper surface guide 313. Moreover, the guide block is disposed in such a manner as to project onto the sheet conveyance path when the looped sag is formed in the sheet. If the sheet meanders in the normal print mode and the rewinding mode in the state in which the looped sag is formed in the sheet, the side edge of the sheet abuts against the guide block according to the width of the sheet, to be thus guided by the guide block. In this manner, the meander of the sheet is corrected, and therefore, the stable conveyance can be kept. As shown in, for example, FIG. 12A, if a widest sheet SL' meanders, the guide blocks 318*e* and 318*e*' act on the sheet, thereby correcting the meander. In contrast, as shown in, for example, FIG. 12B, if a narrowest sheet SS' meanders, the guide blocks 318*a* and 318*a*' act on the sheet, thereby correcting the meander.

In the above-described second preferred embodiment, the stepwise guide that is disposed upstream of the looped sag in the sheet and can be adapted for the width of the sheet positionally restricts the sheet in the widthwise direction in synchronism with the formation of the looped sag in the sheet, thus ensuring an excellent meander correcting mechanism.

Moreover, it is unnecessary to change a guide according to the width of the sheet (i.e., the apparatus is maintenance-free), it is possible to provide a sheet conveyance apparatus having a high operability and being capable of reducing a conveyance error caused by an assembling error.

While the present invention has been described with reference to the exemplary embodiments, it is to be understood that the invention is not limited to the disclosed the exemplary embodiments. The scope of the following claims is to be accorded the broadest interpretation so as to encompass all such modifications and equivalent structures and functions.

This application claims the benefit of Japanese Patent Application No. 2011-231284 filed on Oct. 21, 2011, which is hereby incorporated by reference herein in its entirety.

What is claimed is:

1. A sheet conveyance apparatus comprising:

a sheet conveyance path;

a loop forming unit that is disposed on the sheet conveyance path and sags, in a loop, the sheet to be conveyed; and a guide unit that is stepwise high at both sides and low at the center, as viewed in a sheet conveyance direction, and which extends in the sheet conveyance direction, wherein the sheet sagging in the loop by the loop forming unit enters a guide region being defined by opposite guide faces of paired steps in the stepwise guide unit and having a width according to the width of the sheet, so that the side edges of the sheet abut against the guide faces, thus correcting the skewing of the sheet in the sheet conveyance direction.

2. A sheet conveyance apparatus according to claim 1, wherein the loop forming unit is provided with a cantilever flap and forms a looped sag in the sheet in a space produced by a flap opening operation.

3. A sheet conveyance apparatus according to claim 2, further comprising: a first driving roller and a second driving roller that convey the sheet, the second driving roller being disposed downstream of the first driving roller on the sheet conveyance path, wherein the cantilever flap is interposed between the first driving roller and the second driving roller, and after the flap opening operation, the second driving roller stops whereas the first driving roller is rotated, thus forming the looped sag in the sheet.

4. A sheet conveyance apparatus according to claim 2, wherein the guide unit projects onto the sheet conveyance path in association with the flap opening operation.

5. A sheet conveyance apparatus according to claim 1, wherein the guide unit is provided upstream of the loop forming unit on the sheet conveyance path.

6. A sheet conveyance apparatus according to claim 1, wherein the guide unit is provided downstream of the loop forming unit on the sheet conveyance path.

7. A sheet conveyance apparatus according to claim 1, wherein a number and widths of guide regions in the guide unit are set in such a manner as to be equal to the number and different widths of sheets to be conveyed, respectively.

8. A sheet conveyance apparatus according to claim 7, wherein the widths of the guide regions are greater than the different widths of the sheets to be conveyed.

9. A sheet conveyance apparatus according to claim 1, further wherein each step of the stepwise guide unit has an opposite guide face, each of which is inversely tapered toward a wide open end, in such a manner that the sheet readily enters the guide region according to the sheet width.

10. A sheet conveyance apparatus according to claim 1, further comprising a sheet feeding unit adapted to convey the sheet in a first direction and a second direction reverse to the first direction.

11. A sheet conveyance apparatus according to claim 1, further comprising:

a sheet feeding unit for holding and feeding the sheet, the sheet being held in the sheet feeding unit in a manner wound in a roll.

12. A printing apparatus comprising:

the sheet conveyance apparatus according to claim 1; and a printing unit that prints an image on a sheet conveyed by the sheet conveyance apparatus.

13. A conveyance apparatus comprising:

a first conveying unit that conveys a printing medium;

a second conveying unit that is provided downstream in a conveyance direction of the first conveying unit, for conveying the printing medium;

a first guide face that is interposed between the first conveying unit and the second conveying unit, so as to guide the side edge of a printing medium having a first width, the printing medium of the first width sagging of the second width between the first conveying unit and the second conveying unit; and a second guide face that is interposed between the first conveying unit and the second conveying unit, so as to guide the side edge of a printing medium having a second width smaller than the first width, the printing medium of the second width sagging between the first conveying unit and the second conveying unit;

the second guide face being disposed at a shifted position from the first guide face in the thickness direction of the printing medium to be conveyed.

14. A conveyance apparatus according to claim 13, wherein the second guide face is disposed at a shifted position from the first guide face in the thickness direction of the printing medium to be conveyed and in a direction in which the printing medium further sags.

15. A conveyance apparatus according to claim 13 or 14, wherein the second guide face is shifted from the first guide face in the widthwise direction of the printing medium to be conveyed.

16. A conveyance apparatus comprising:

a first conveying unit that conveys a printing medium;

a second conveying unit that is provided downstream in a conveyance direction of the first conveying unit, for conveying the printing medium; and a guide face disposed between the first conveying unit and the second conveying unit, wherein the guide face guides the side edge of a printing medium when the printing medium sags between the first conveying unit and the second conveying unit.

17. A conveyance apparatus according to claim 16, wherein the guide face does not guide the side edge of a printing medium when the printing medium does not sag between the first conveying unit and the second conveying unit.

18. A conveyance apparatus according to claim 16, wherein the printing medium is a continuous sheet.

19. A conveyance apparatus comprising:

a first conveying unit that conveys a printing medium;

a second conveying unit that is provided downstream in a conveyance direction of the first conveying unit, for conveying the printing medium; and a guide face disposed between the first conveying unit and the second conveying unit, wherein the guide face guides the side edge of a printing medium when a sag formed in the printing medium between the first conveying unit and the second conveying unit is of a first amount, wherein the guide face does not guide the side edge of a printing medium when a sag formed in the printing medium between the first conveying unit and the second conveying unit is of a second amount smaller than the first amount,

20. A conveyance apparatus according to claim 19, wherein the printing medium is a continuous sheet and the first conveying unit draws and conveys the continuous sheet from a roll of the continuous sheet.

21. A conveyance apparatus according to claim 20, wherein when the first conveying unit and the second conveying unit convey the continuous sheet in a direction opposite to the conveyance direction and the continuous sheet is rewound in to the roll, the first amount of sag is formed in the printing medium between the first conveying unit and the second conveying unit.

* * * * *